US007877946B1

(12) United States Patent
Stepanek

(10) Patent No.: US 7,877,946 B1
(45) Date of Patent: Feb. 1, 2011

(54) WEEP VENT

(75) Inventor: Gordon J. Stepanek, Bartlett, IL (US)

(73) Assignee: Illinois Products Corporation, South Elgin, IL (US)

( * ) Notice: Subject to any disclaimer, the term of this patent is extended or adjusted under 35 U.S.C. 154(b) by 102 days.

(21) Appl. No.: 12/125,217

(22) Filed: May 22, 2008

(51) Int. Cl.
*E04B 1/64* (2006.01)
*E04B 1/72* (2006.01)

(52) U.S. Cl. ..... 52/302.3; 52/302.1; 52/310

(58) Field of Classification Search ..... 52/101, 52/302.1, 302.3, 310, 67
See application file for complete search history.

(56) References Cited

U.S. PATENT DOCUMENTS

| | | | | |
|---|---|---|---|---|
| 2,934,931 | A * | 5/1960 | Johnson | 52/302.3 |
| 3,429,084 | A * | 2/1969 | Brewer | 52/101 |
| 4,102,093 | A * | 7/1978 | Harris | 52/101 |
| 4,282,691 | A * | 8/1981 | Risdon | 52/101 |
| 4,587,891 | A * | 5/1986 | Kruse | 454/271 |
| 5,218,798 | A * | 6/1993 | Bentivegna et al. | 52/206 |
| 5,274,968 | A * | 1/1994 | Pardo | 52/97 |
| 6,044,594 | A | 4/2000 | Desselle | |
| 6,105,323 | A * | 8/2000 | Paulle | 52/302.1 |
| 6,112,476 | A | 9/2000 | Schulenburg | |
| 6,176,048 | B1 * | 1/2001 | Berger | 52/101 |
| 6,202,336 | B1 | 3/2001 | Audino | |
| 6,305,739 | B1 * | 10/2001 | Corona | 296/165 |
| 6,360,493 | B1 * | 3/2002 | Torres, III | 52/101 |
| 6,394,706 | B1 * | 5/2002 | Gentry | 405/284 |
| 6,474,031 | B2 * | 11/2002 | Phillips | 52/302.1 |
| 6,619,004 | B2 * | 9/2003 | Loper | 52/302.1 |
| 6,662,504 | B2 * | 12/2003 | Krogstad | 52/61 |
| 6,796,590 | B2 * | 9/2004 | Schneider | 296/26.13 |
| 7,419,202 | B1 * | 9/2008 | Hanser et al. | 296/26.13 |
| 2001/0023564 | A1 * | 9/2001 | Phillips | 52/302.1 |
| 2004/0058638 | A1 * | 3/2004 | Achen | 454/277 |
| 2004/0134147 | A1 * | 7/2004 | Warren | 52/302.1 |
| 2005/0066599 | A1 * | 3/2005 | Kimble | 52/302.1 |
| 2005/0262785 | A1 * | 12/2005 | Alexander | 52/302.1 |

* cited by examiner

*Primary Examiner*—Khoi Tran
*Assistant Examiner*—Jason Holloway
(74) *Attorney, Agent, or Firm*—Patnaude and Videbeck

(57) ABSTRACT

An improved weep vent for use in brick and masonry wall construction includes an adjustability feature that provides a superior vent. The vent includes an outer inverted U-shape casing having an inner smaller inverted U-shape member slidably retained in the casing, and an open mesh insert type plug that fits in front of the casing to keep out insects while allowing water to drain outwardly. During installation, the casing is positioned adjacent the side of bricks of the first course above a foundation or at other locations. The sliding member is extending out the back of the casing until it contacts the balloon frame or masonry, flashing or other obstructions. Then mortar is positioned over the vent. Excessive mortar does not clog the vent.

1 Claim, 2 Drawing Sheets

WEEP VENT

This invention relates to weep vents for masonry walls and, more particularly, to an adjustable weep vent having a mesh insert that is adapted to slide inwardly of the masonry wall to contact an inner balloon frame or masonry backup wall.

BACKGROUND OF THE INVENTION

Masonry built buildings need venting in certain areas and sealing in other areas. One of the areas where venting is desired and required by many building codes, is venting at the top of a concrete foundation where the first layer of bricks or masonry block, or the like sit on top of the foundation. The venting is between the outside and an open dead air area between the masonry wall and the outer insulation on a balloon frame or an outer masonry layer and an inner masonry layer spaced apart therefrom, commonly called a cavity wall.

Patents disclosing weep vents sized for brick masonry walls include U.S. Pat. Nos. 6,474,031 and 6,112,476, along with 6,662,504. A drainage system for use with a masonry wall, pillar or the like is shown at U.S. Pat. No. 6,202,336. Other patents including screens for providing an insect or animal blockage at the front of weep vents includes U.S. Pat. Nos. 6,176,048; 6,360,493 and 6,044,594.

While all these embodiments in the above identified patents provide some form of a weep vent, and many also provide for adding preventive structures to keep out insects and unwanted animals, some also provide a cover or other means to prevent the interior opening of the weep vent from becoming clogged or covered by dropping mortar. A need has developed to provide an improved weep vent apparatus that combines all of the above mentioned features in an improved weep vent structure.

SUMMARY OF THE INVENTION

It is an object of the invention, generally stated, to provide a new and improved weep vent for brick and masonry wall building structures. Another object of the invention is the provision of a weep vent usable with a brick or masonry wall construction that includes an insect or animal barrier in connection therewith while providing adjustability of the size of same.

A further object of the present invention is the provision of a collapsible weep vent assembly providing an insect or animal barrier that is expandable to provide not only a weep vent that extends completely through the brick or masonry wall at a mortar site, but also includes an expandable portion that is capable of extending completely through the internal air space (cavity) between the exterior masonry wall and the balloon frame or the interior masonry backup wall.

The invention is directed to an adjustable length weep vent for use on brick and masonry walls, that comprise a hollow inverted U-shape casing having a length about 3.5 inches. An expansion member is slidably housed within a hollow interior of the U-shape casing. The expansion member is shorter in length than said casing member. An insert means is positioned adjacent one end of said hollow casing for preventing the entrance of animal life into the vent while allowing liquid to flow outwardly thereof.

BRIEF DESCRIPTION OF THE DRAWINGS

The features of the present invention which are believed to be novel are set forth with particularity in the appended claims. The invention may best be understood from the following detailed description of a currently preferred embodiment thereof taken in conjunction with the accompanying drawings wherein like numerals refer to like parts, and in which:

DETAILED DESCRIPTION OF THE PREFERRED EMBODIMENT

Figure 1A:
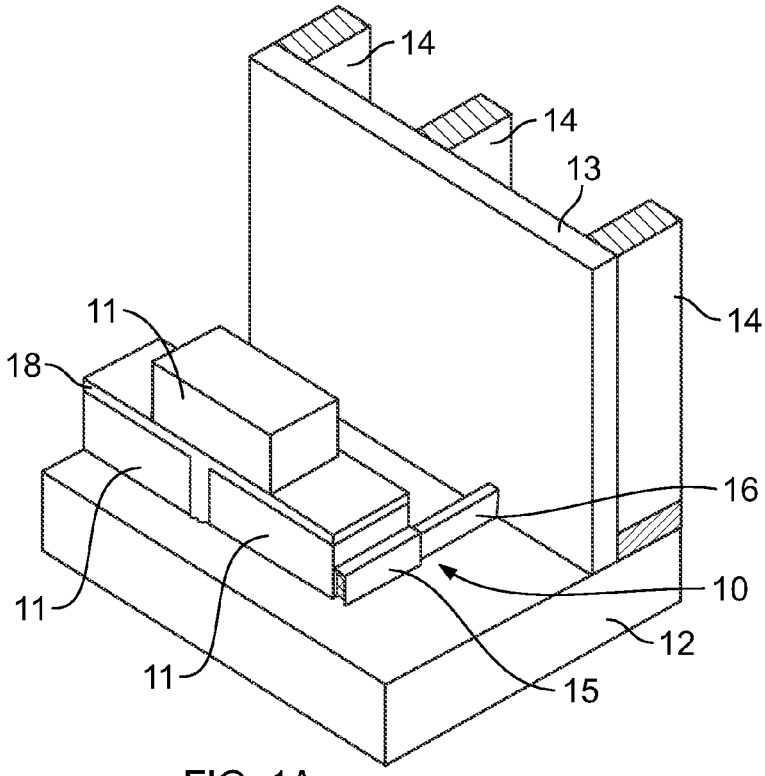
FIG. 1A is a fragmentary detail perspective view, with portions cut away for clarity of showing a weep vent constructed in accordance with the present invention as it appears mounted in extended position alongside a brick veneer construction positioned on top of a concrete foundation.

Referring to FIG. 1A, an adjustable weep vent, is generally indicated at 10, constructed in accordance with the present invention. The weep vent 10 is positioned adjacent a brick (or block) 11-11 as part of the lowest course of a masonry brick wall which sits upon a concrete foundation 12. Since FIG. 1A is a fragmentary view, it should be noted that in a complete wall structure, the weep vent of the invention fits in a mortar slot between adjacent bricks 11-11 in the lower course of a brick masonry wall or higher in the wall wherever flashing is required. Behind the brick wall there is a dead air space between the masonry and the insulation 13 of a balloon frame, generally indicated by two by fours 14-14. This is known as brick veneer construction. Many municipalities require the masonry wall construction shown in FIG. 1A, including the use of some type of weep vent.

Figure 1B:
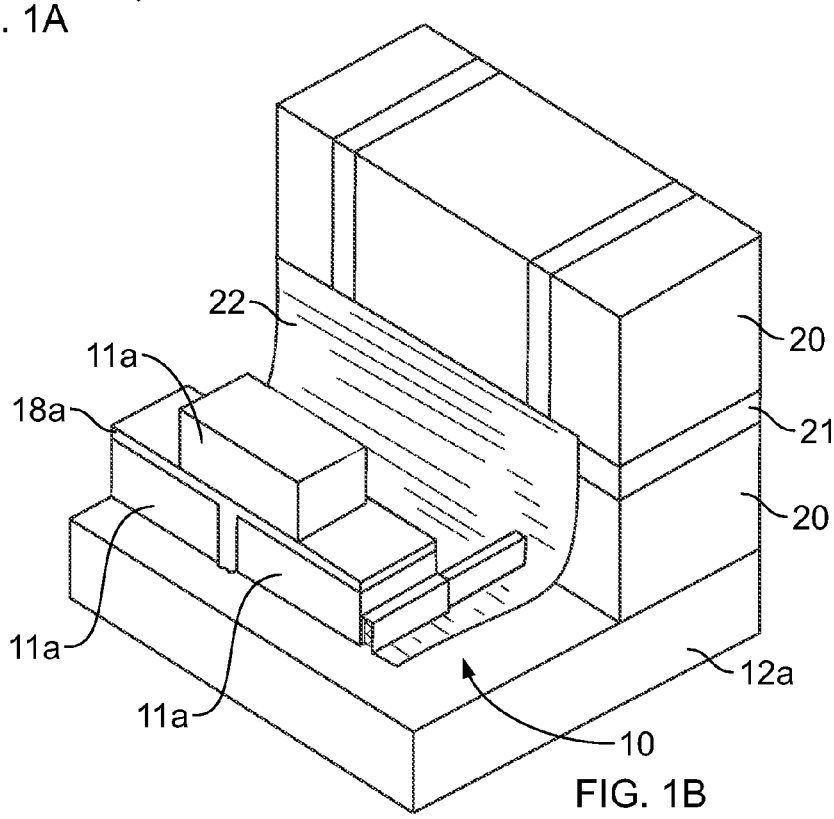
FIG. 1B is a fragmentary detail perspective view, with portions cut away for clarity of showing the weep vent constructed in accordance with the present invention as it appears mounted in extended position alongside a brick positioned alongside a brick and masonry block construction on top of a concrete foundation.
Figure 2:
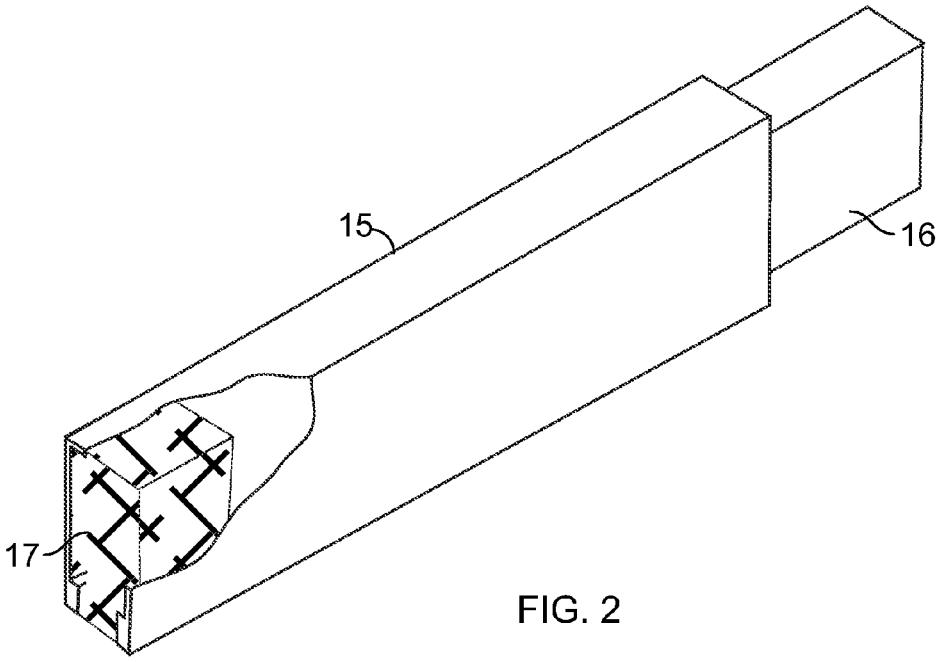
FIG. 2 is a three-quarter elevational perspective view of the weep vent of the invention shown in FIGS. 1A and 1B.
Figure 3:
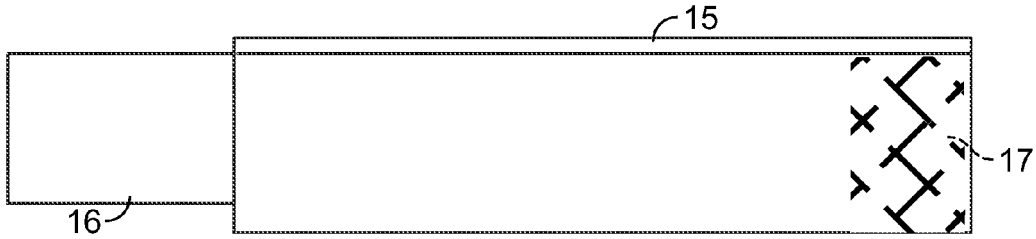
FIG. 3 is a side elevational view of the weep vent of the invention shown in FIGS. 1A, 1B and 2.
Figure 4:
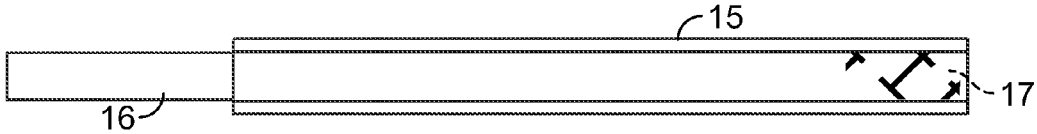
FIG. 4 is a top plan view of the weep vent shown in FIG. 3.
Figure 5:
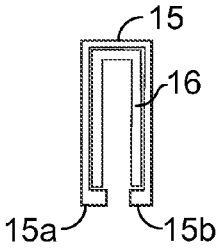
FIG. 5 is an end elevational view of the weep vent.
Figure 6:
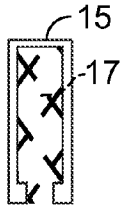
FIG. 6 is an enlarged end view of the porous mesh member of the weep vent assembly.
Figure 7:
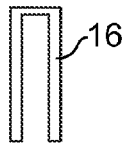
FIG. 7 is an end elevational view of the solid member of the weep vent assembly.

In one important aspect of the present invention, as can be most clearly shown in FIGS. 1A, 1B and 2, the weep vent 10 of the present invention is formed of three members, a high impact resistant, rigid polyvinylchloride vent casing 15, a hollow, open bottom expansion or slider member 16 slidable inside the casing 15 and a mesh insect screen 17 positioned as a plug in the front end of the outside member 15. When in use, as shown most clearly in FIG. 1A, the vent casing 15 is positioned adjacent the side of a brick or masonry block in the cavity therebetween where mortar 18 is ordinarily placed. Casing 15 may extend beyond the back of bricks 11-11 into the hollow cavity, but in the preferred embodiment, it is about at least as long as the thickness of the brick. The slidable expansion member 16 is then slid outwardly of the vent casing until it contacts the outer wall of the insulation 13, completely bridging the space between the masonry wall 11-11 and the balloon frame 14-14. Thereafter, mortar may be positioned in the spacing above the mesh member 16 and the masonry wall built therearound.

It is an important aspect of the present invention to install the vent on a dry foundation, i.e., without wet mortar thereunder. By sliding the member 16 outwardly of the back end of the casing 15 until its open end is closed by the balloon frame, the adjustable sliding weep vent 10 of the present invention cuts off insect or animal migration into and out of the space between the masonry and balloon frame and also provides a means for catching any loose or spilled mortar 18 from between the joints and preventing such mortar from closing the vent 10. The open bottom of the vent allows liquid (water) to pass outwardly of the course of bricks.

Referring to FIG. 1B, the same weep vent 10 of the invention is shown positioned adjacent a brick 11*a* mounted on the concrete foundation 12*a* of a masonry wall that includes a plurality of concrete blocks 20-20 joined by mortar 21 in spaced relation behind the outer wall of bricks 11*a*-11*a*. A flashing 22 is shown mounted under the bottom row of bricks 11*a*-11*a*, extending to the masonry wall blocks 20-20 and then upward at least about 7⅝ inches. Typically, the concrete blocks are nominally 8×8×16 inches.

Since the outer casing 15 is longer than the inner expansion member 16, the member 16 may be stored, shipped or the like fully inside of the casing 15 without interfering with the mesh insect screen or plug 17 at the front end of the casing 15.

In the preferred embodiment, the vent casing 15 is 3⅝ inches in length, 1 inch in height and ⅜ inch in width. The wall thickness is typically 0.045 inch and the interiorly extending feet 15*a* and 15*b* are ⅛ inch in height and approximately 1/10 inch in thickness. In the preferred embodiment, the vent casing 15 is made of clear, high impact resistant, rigid polyvinylchloride, although other materials may be utilized within the scope of the present invention. Other dimensions may also be utilized.

The sliding member 16 is, in the preferred embodiment, made of the same material as the casing 15, namely, clear, high-impact resistant, rigid polyvinylchloride. The preferred dimensions of the slidable member 16 are a length of 3 inches, a height of approximately 8/10 inch and a width of approximately ¼ inch. The sliding member also has a typical wall thickness of 0.045 inch. The hollow portion of the front end of the outside member vent casing 15 has positioned therein an open weave mesh insert or plug 17 that provides for ventilation, and also a clear drainage path, as well as protects the cavity from any animal or insect trying to enter the vent.

This mesh insert 17 approximates ⅝ inch in depth, extends across the complete opening of the front end of the vent casing 15, including the area between the feet 15*a* and 15*b* thereof, and is preferably made of nylon mesh, although it can be made of other materials within the scope of the present invention. The mesh prevents insects from entering the voided area inside the weep vent, while allowing water to drain outwardly of the vent. It should be noted that the fact that sliding member 16 slides outwardly on top of the feet 15*a*, 15*b* of the weep port or casing member 15 allows water to drain through the open area between the feet of the casing 15 outwardly of the weep vent.

The adjustable weep vent is installed while laying the first course of bricks every 24 inches on center, or as local building codes require. The weep vent may be installed directly on the flashing with the open edge down, and with all mortar removed from the bed joint where the weep vent lays.

The adjustable weep vent may also be installed at the top of the wall as a vent or at shelf angles or lintels. If no rigid insulation board, such as shown in FIG. 1A at 13 is used, the weep vent extension 16 may be extended to the backup wall. If rigid insulation board is being installed in the cavity, the weep vent extension is extended to the face of the rigid insulation board as shown in FIG. 1A. For those installations that use an integrated rigid insulation board and drainage mat, the extension member 16 of the weep vent should extend to the face of the drainage mat. The weep vent member is rigid and will not collapse when mortar is positioned thereover.

Thus, a new and improved weep vent has been shown and described. While one preferred embodiment of the invention has been shown and described, it will be apparent to those skilled in the art that many changes and modifications may be made without departing from the true spirit and scope of the present invention. It is the intent of the appended claims to cover all such changes and modifications which fall within the true spirit and scope of the invention.

What is claimed:

1. An adjustable length weep vent for use on brick and masonry walls allowing air and water to exit the vent while preventing insects and animal life from entering the vent, said vent comprising:

a hollow inverted U-shape casing having a length at least about equal to the thickness of one of a brick and masonry block, and a pair of feet inwardly extending from each of the distal ends of said U-shape casing along substantially the length thereof, a slider member also having an inverted U-shape slidably housed within a hollow interior of said U-shape casing, said slider member being shorter in length than said casing member and shorter in height than said casing with the distal ends of said U-shape slider member slidable along the top of said feet of said casing, an open mesh insert adjacent one end of said hollow casing for preventing the entrance of animal life into said vent while allowing liquid to flow outwardly thereof.

* * * * *